US006100509A

United States Patent [19]

Saito

[11] Patent Number: 6,100,509

[45] Date of Patent: Aug. 8, 2000

[54] COOKING APPARATUS WITH COOKING CONDITION SETTING MEANS

[75] Inventor: Takashi Saito, Tokyo, Japan

[73] Assignee: Jamco Corporation, Tokyo, Japan

[21] Appl. No.: 09/302,188

[22] Filed: Apr. 30, 1999

[30] Foreign Application Priority Data

Jul. 28, 1998 [JP] Japan ..... 10-005628 U

[51] Int. Cl.[7] ..... H05B 1/02

[52] U.S. Cl. ..... 219/494; 219/506; 219/497; 219/714; 340/870.17; 340/825.69

[58] Field of Search ..... 219/714, 497, 219/506, 501, 486, 494, 508, 509; 99/325–333; 340/825.22, 870.16, 870.17, 825.69

[56] References Cited

U.S. PATENT DOCUMENTS 4,323,773 4/1982 Carpenter ..... 235/473
4,837,414 6/1989 Edamula ..... 219/714
5,378,874 1/1995 Holling et al. ..... 219/506
5,535,664 7/1996 Rokowski ..... 99/331

*Primary Examiner*—Mark Paschall
*Attorney, Agent, or Firm*—Armstrong, Westerman, Hattori, McLeland & Naughton

[57] ABSTRACT

A cooking apparatus 10 is equipped with a control means for controlling the cooking condition including time and power, and a cooking condition setting means 30 for outputting a cooking condition signal to said cooking means, wherein the food to be cooked will be heated/cooked according to the time and power set by the cooking condition setting means 30. The cooking condition signal received by the cooking condition setting means 30 is a control signal outputted from a remote controller 50 equipped with a transmission means and a memory for storing the most suitable cooking conditions corresponding to each food to be cooked.

4 Claims, 3 Drawing Sheets

COOKING APPARATUS WITH COOKING CONDITION SETTING MEANS

FIELD OF THE INVENTION

The present invention relates to a heating/cooking apparatus.

DESCRIPTION OF THE RELATED ART

For example, foods or dishes served inside an airplane differs in kind and amount according to the route, the seated class, the season and the like of the flight. The cooking time or the heating power of each dish will differ according to the amount or kind of the food to be cooked, so there was a need for the operator of the heating/cooking apparatus to set the cooking time and the heating power suitable for every dish when operating the apparatus by referring to a cooking list and the like.

Further, in convenience stores and fast food restaurants for example, a cooking time of 10 seconds or 15 seconds and the like are set to the memory switch of the cooking apparatus, and the cooking time was adjusted according to the kind of food to be cooked. However, since fine adjustment of the cooking time according to the kind and amount of food to be cooked was not possible, problems such as overcooking or undercooking of the food occurred. Moreover, accompanied by the increase in the kinds of food to be handled, the setting or changing of the cooking time in the kitchen became very complicated. The time needed to operate the apparatus was increased, and operators made mistakes such as pressing the wrong button or setting the wrong cooking time. Because of such situation, it became difficult to follow the appropriate cooking conditions requested by the food supplier for cooking each food.

SUMMARY OF THE INVENTION

Therefore, the present invention provides a cooking apparatus with a unit for setting the cooking conditions, wherein the best cooking conditions for each dish may be set easily, and various dishes may be cooked under the best cooking conditions requested by the food supplier.

The cooking apparatus according to the present invention comprises a control means for controlling cooking conditions such as time and heating power, and a cooking condition setting means comprising a receiving means for receiving a cooking condition signal and outputting said cooking condition control signal to said control means, for heating and cooking the food to be cooked according to the time and heating power set by said cooking condition setting means, wherein the cooking condition signal received by said cooking condition setting means is a control signal outputted from a remote controller equipped with a transmission means and a memory means for storing the most suitable cooking conditions corresponding to each food to be cooked.

Further, the cooking apparatus according to the present invention is equipped with a barcode reader, wherein said cooking condition setting means is equipped with a cooking condition signal converting means for converting the barcode information to a cooking condition signal, and said converted cooking condition signal is outputted to said control means, the information recorded on the barcode characterized in being the most suitable cooking conditions corresponding to each food to be cooked.

PREFERRED EMBODIMENT OF THE INVENTION

The preferred embodiment of the present invention will now be explained with reference to the accompanied drawings.

According to the present embodiment, a microwave range is used as the heating/cooking apparatus.

Embodiment 1

Figure 1:
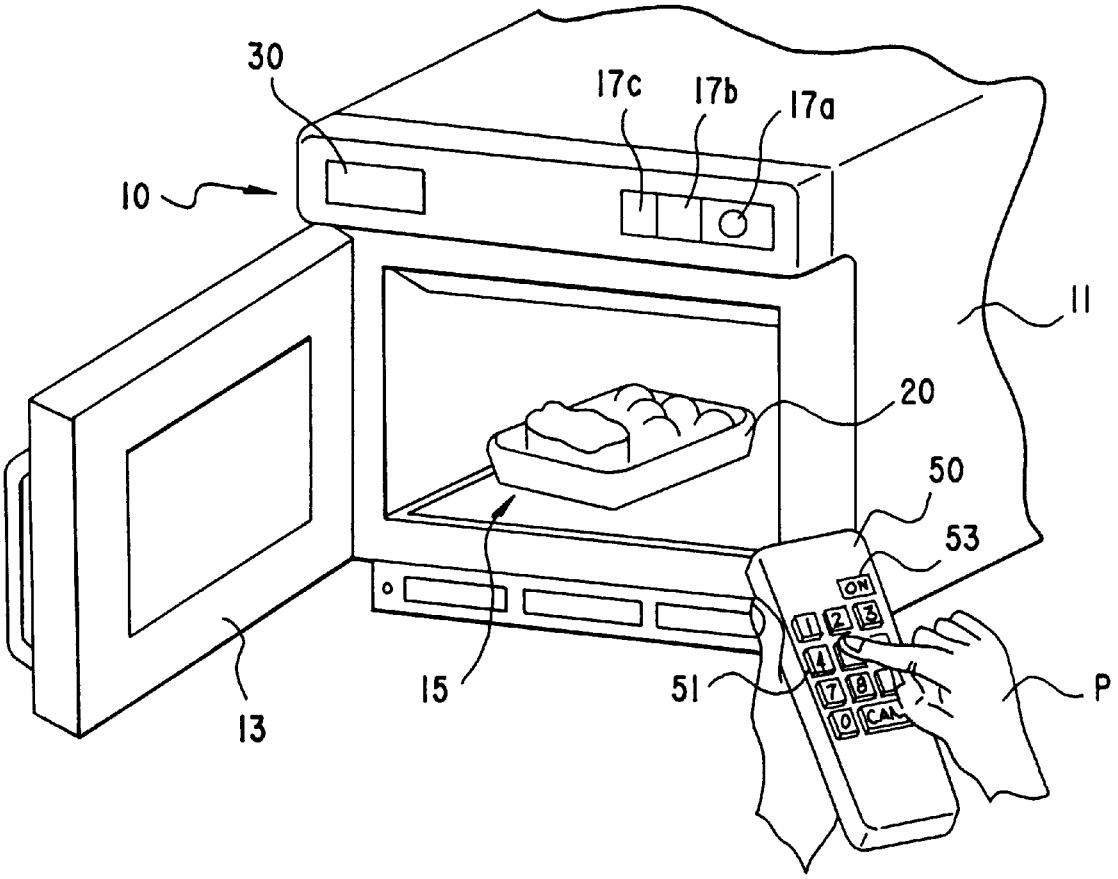
FIG. 1 is an explanatory view showing the operation of the cooking apparatus with a cooking condition setting means according to the first embodiment of the present invention.
Figure 2:
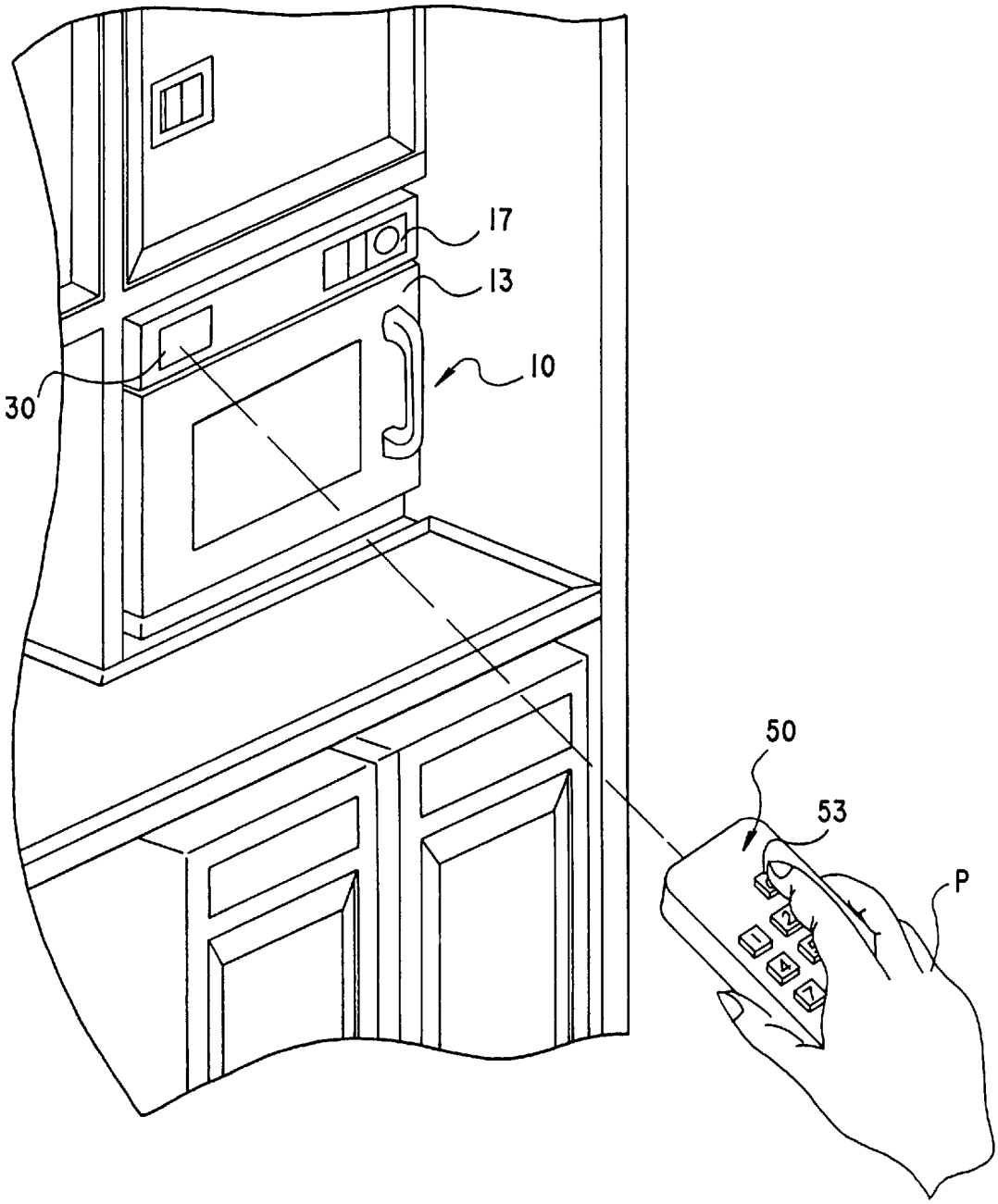
FIG. 2 is an explanatory view showing the operation of the cooking apparatus with a cooking condition setting means according to the first embodiment of the present invention.
Figure 3:
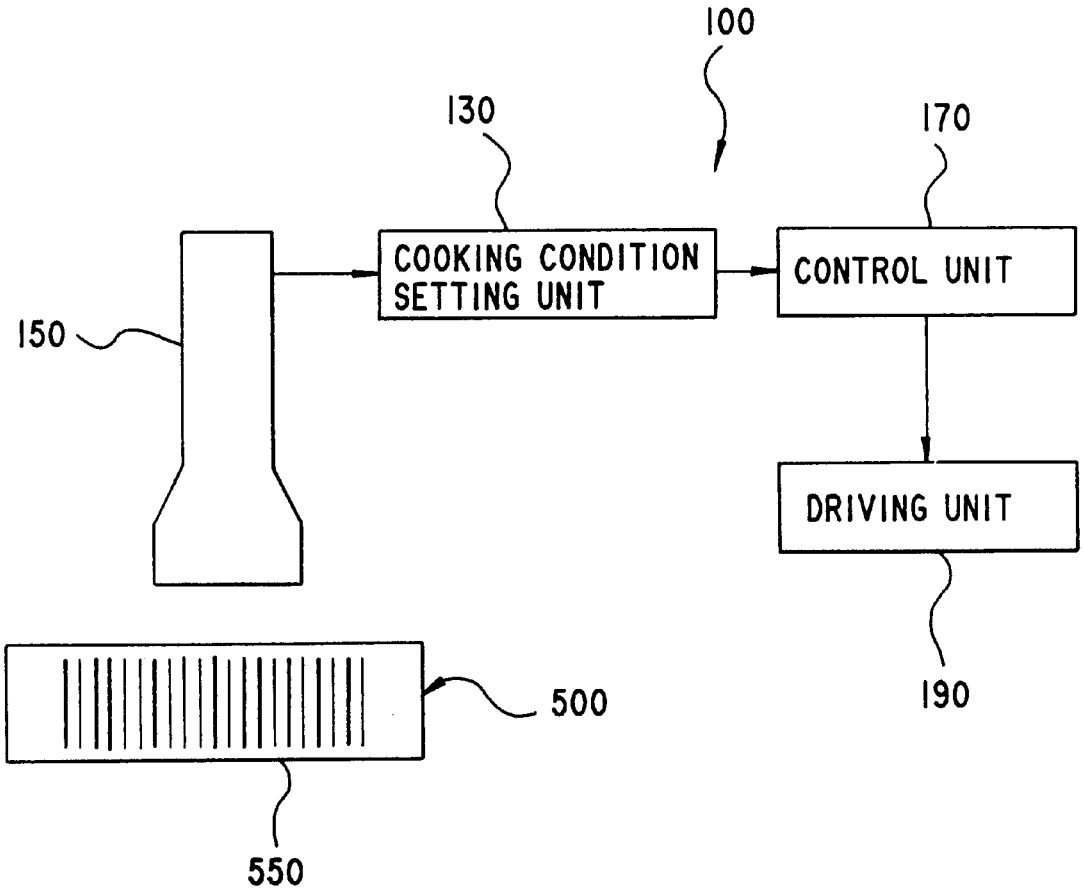
FIG. 3 is an explanatory view showing the outline of the operation of the cooking apparatus according to the second embodiment of the present invention.

FIG. 1 shows a cooking apparatus 10 which is a microwave range, and the cooking apparatus 10 is equipped with a door 13 mounted on a box-shaped body 11 which could be opened and closed by the user. In the interior 15 of the range which may be accessed through said door is mounted a seat for mounting a cooker. The heating or cooking of the food is performed by placing the food to be cooked 20 on the seat, and irradiating the food 20 with an electromagnetic wave.

An operation unit 17 and a cooking condition setting unit 30 are formed on the appropriate positions of the cooking apparatus 10.

The operation unit 17 is equipped with a controller 17*a* for adjusting the cooking time, the heating power and the like manually, a selection key 17*b*, a start key 17*c* and the like, wherein the conditions set by the controller 17*a* or selected by the selection key 17*b* may be displayed. The cooking conditions corresponding to each food to be cooked are stored in the memory of the control unit of the cooking apparatus 10 in advance, and by selecting the name of the food and the like by the selection key 17*b*, the cooking apparatus heats the food based on the cooking condition, such as the time and the heating power, stored in the cooking apparatus. The cooking conditions stored in the memory of the apparatus corresponding to the selection key 17*b* may not be erased.

The cooking condition setting unit 30 is equipped with a receiving means for receiving the cooking time/heating power signal, and an output means for outputting the cooking signal indicating the cooking time or the heating power to the control unit.

The cooking condition setting unit 30 outputs the signal including the information regarding the received cooking condition to the control unit, and the control unit performs the heating for a predetermined time according to the cooking conditions by the received order.

The cooking condition setting unit 30 receives the cooking condition signal transmitted from the remote controller 50.

The remote controller 50 is a portable apparatus with a memory, and in the memory are stored a plurality of cooking conditions. The cooking conditions stored in the memory may be selected by a plurality of control buttons 51 formed on the operation surface of the controller.

The cooking conditions stored in the remote controller 50 are set by the supplier corresponding to every food to be cooked.

The supplier sets and stores in the memory the cooking conditions suiting the kind or quantity of foods to be delivered to airplanes, convenience stores, restaurants and the like in advance.

The cooking condition selected by the control buttons 51 is transmitted to the cooking condition setting unit 30, and the cooking condition information is set to the cooking apparatus 10.

The method of using the cooking apparatus with the cooking condition setting unit mentioned above will now be explained.

(1) Cooking According to Input by Operation Unit 17

The user P sets the cooking conditions (including the cooking time and the heating power) by the controller 17*a* on site (in the kitchen), which is most suited for the food to be cooked. In another example, the user selects the cooking conditions which suits the food to be cooked stored in the memory of the cooking apparatus by the selection key 17*b*. Then, by pressing the start key 17*c*, the electromagnetic wave is generated and the heating of the food is started.

(2) Cooking According to Cooking Condition Setting Unit 30

In this example, the food is cooked according to the orders from the remote controller 50 storing the cooking conditions corresponding to the types of food to be cooked.

The example of applying the present invention on an airplane is explained. The food or dish to be cooked and served during the flight, for example, are meat, fish and soup.

The remote controller 50 stores the cooking conditions suited for the meat to be served, the cooking conditions suited for the fish, and the cooking conditions suited for the soup.

The "1" button of the buttons 51 corresponds to the cooking condition set for the fish dish, the "5" button corresponds to the cooking condition for the meat dish, and the "9" button corresponds to the cooking condition for the soup dish.

The method of cooking the dish (meat dish) 20 will now be explained with reference to FIG. 1.

The suitable cooking conditions of the dish 20 is set as follows: the heating strength is high and the heating time is 3 minutes.

The cooking conditions for the meat dish is set at button "5" of the buttons 51, so this button is selected.

The operator P places the dish 20 in the interior 15 of the apparatus, closes the door 13, and presses the button numbered "5" of the buttons 51 on the remote controller 50.

The remote controller 50 transmits the cooking conditions stored in the memory corresponding to the selected button, and the information is transferred to the cooking condition setting unit 30 of the cooking apparatus 10.

Then, by pressing the start button 53, the control unit of the cooking apparatus 10 controls the output of the electromagnetic wave according to the cooking conditions, where the heating power is high and the heating time is three minutes.

Thereby, the dish 20 may be cooked by the best cooking condition as the meat dish.

By linking the food to be served on the airplane with the remote controller 50 where the most suitable cooking conditions of each food may be inputted, the operation for setting the cooking conditions by the operator on the airplane is simplified, since there is no need for the operator to reset the cooking condition manually for every food to be cooked. Moreover, the food or dish to be served may be cooked by the most suitable cooking conditions set for every dish, so no overcooking or undercooking will occur. Therefore, the served meal will be of high satisfactory.

As explained above, according to the present invention, the cooking conditions suitable for the kind of food to be delivered to air planes, convenience stores, restaurants and the like are set in advance, or a remote controller 50 is supplied simultaneously when supplying the food, or the suitable cooking conditions of the delivered food is reset to the remote controller 50 when delivering the food. Therefore, the cooking conditions requested by the supplier for each food may be unified easily, and a better service may be provided.

Moreover, when cooking the food with a plurality of cooking apparatuses, the most suitable cooking conditions for each food may be set by an easy operation of the remote controller 50, by simply selecting the kind of food to be cooked, and the information may be transmitted to each apparatus by a remote operation.

Embodiment 2

The present embodiment performs the transmission of cooking conditions to the cooking condition setting unit by a barcode and a barcode reader.

The cooking apparatus 100 is equipped with a barcode reader 150, and the barcode reader 150 is connected to the cooking condition setting unit 130.

The barcode reader 150 reads the barcode information 550 recorded on a barcode sheet 500 delivered with the food, and transmits the information to the cooking condition setting unit 130. The cooking condition setting unit 130 converts the received barcode information to a cooking condition signal, and outputs the signal to the control unit 170.

The control unit outputs a drive order including the cooking time and heating power to the driving unit 190 based on the received cooking condition.

The barcode 550 recorded on the barcode sheet 500 includes the information on the most suitable cooking condition according to the kind and amount of each food to be delivered, and the supplier sets and records these information in advance for every food to be cooked.

The barcode sheet 500 may be adhered to the container of foods and the like, or may be adhered to a board and the like to be delivered together with the food. By utilizing the barcode and the barcode reader, the setting of the most suitable cooking condition for each food may be performed easily.

The cooking apparatus according to the present embodiment is advantageous since the most suitable cooking condition for the food to be cooked by the apparatus may be set easily and correctly even when cooking the food with a plurality of cooking apparatuses, by simply reading the barcode with the barcode reader.

The cooking apparatus with a cooking condition setting unit according to the present invention enables to set the different cooking conditions most suitable for each of the many kinds of food to be cooked on airplanes and the like simply and accurately in a short time.

Further, according to the invention, there is no need to set the cooking condition of each food at the cooking site (in the kitchen). Instead, by simply selecting a button on the remote controller, or by reading a barcode information, the best cooking conditions may be applied when cooking each food. Therefore, cooking troubles such as overcooking and undercooking may be prevented, and a satisfying service may be provided.

Moreover, the utilization of remote controllers for setting the cooking conditions enable remote operation, and the space necessary when cooking food may be saved.

What is claimed is:

1. A microwave cooking apparatus for heating and cooking food according to a set time and power, comprising:

a body having an interior for receiving food to be cooked;

a control means on the body for controlling cooking conditions such as time and power, a cooking condition setting means on the body having, a receiving means for receiving a cooking condition signal from a remote controller, and an output means for outputting the cooking condition signal to the control means; and the remote controller having, a memory for storing cooking condition information for different foods, a transmitter for transmitting information on cooking conditions in the form of a cooking condition signal;

whereby cooking condition information necessary for the apparatus to properly cook each type of food may be set by choosing the type of food to be cooked from a selection on the remote controller.

2. A cooking apparatus with a cooking condition setting means according to claim 1, wherein said cooking conditions stored in said memory of said remote controller is set corresponding to every food to be cooked.

3. A microwave cooking apparatus for heating and cooking a food according to a set time and power, comprising:

a body having an interior for receiving food to be cooked;

a control means on the body for controlling cooking conditions such as time and power, a cooking condition setting means on the body having, a receiving means for receiving a cooking condition signal from a remote controller, a converter means for converting barcode information to the cooking condition signal, an output means for outputting the cooking condition signal to the control means, and a barcode reader for transmitting information recorded on a barcode to said cooking condition setting means; and the remote controller having, a memory for storing cooking condition information for different foods, a transmitter for transmitting information on cooking conditions in the form of a cooking condition signal;

whereby, in the absence of bar coded food, cooking condition information necessary for the apparatus to properly cook each type of food may be set by choosing the type of food to be cooked from a selection on the remote controller.

4. A cooking apparatus with a cooking condition setting means according to claim 3, wherein said cooking conditions recorded on said barcodes is set corresponding to every food to be cooked.

* * * * *